US006120957A

United States Patent [19]

Miyamoto et al.

[11] Patent Number: 6,120,957

[45] Date of Patent: Sep. 19, 2000

[54] TONER AND LIQUID DEVELOPER

[75] Inventors: Hidetoshi Miyamoto, Takatsuki; Toshimitsu Fujiwara, Osaka; Keyaki Yogome, Kyoto, all of Japan

[73] Assignee: Minolta Co., Ltd., Osaka, Japan

[21] Appl. No.: 09/337,680

[22] Filed: Jun. 22, 1999

[30] Foreign Application Priority Data

Jun. 24, 1998 [JP] Japan ..... 10-177049
Jun. 24, 1998 [JP] Japan ..... 10-177055

[51] Int. Cl.[7] ..... G03G 9/09; G03G 9/12

[52] U.S. Cl. ..... 430/106; 430/111; 430/114; 430/115

[58] Field of Search ..... 430/106, 111, 430/114, 115

[56] References Cited

U.S. PATENT DOCUMENTS 4,870,164 9/1989 Kühne et al. ..... 534/742
4,935,502 6/1990 Kühne et al. ..... 534/742
5,578,407 11/1996 Kasuya et al. ..... 430/111
5,702,860 12/1997 Koyama et al. ..... 430/137
5,712,068 1/1998 Dalal et al. ..... 430/106
5,721,083 2/1998 Masuda et al. ..... 430/106
5,738,716 4/1998 Santilli et al. ..... 106/31.77
5,843,605 12/1998 Anno et al. ..... 430/106
5,928,419 7/1999 Uemura et al. ..... 106/493

FOREIGN PATENT DOCUMENTS 0 705 886 A2 4/1996 European Pat. Off. .
8-209017 8/1996 Japan .

*Primary Examiner*—Roland Martin
*Attorney, Agent, or Firm*—Burns, Doane, Swecker & Mathis, LLP

[57] ABSTRACT

Toner includes binder resin having an acid value in a range from 10 mgKOH/g to 100 mgKOH/g; and at least one kind of compound selected from among Color Index Pigment Yellow 180 and derivatives thereof. A liquid developer includes the toner and carrier liquid. Toner includes binder resin having a weight average molecular weight (Mw) in a range from 3000 to 10000; and at least one kind of compound selected from among Color Index Pigment Yellow 180 and derivatives thereof. A liquid developer includes the toner and carrier liquid.

16 Claims, 1 Drawing Sheet

TONER AND LIQUID DEVELOPER

The invention is based on patent application Nos. 10-177049 Pat. and 10-177055 Pat. filed in Japan, the contents of which are hereby incorporated by reference.

BACKGROUND OF THE INVENTION

1. Field of the Invention

The present invention relates to toner and liquid developer including the toner which are used for image formation, and particularly relates to electrophotographic toner and an electrophotographic liquid developer which are used for developing electrostatic latent images in image forming apparatuses such as electrophotographic copying machines and printers. More particularly, the invention relates to yellow toner and a yellow liquid developer.

2. Description of the Background Art

Offset printing has been employed as a method for formation or duplication of fine and beautiful full-color images. The offset printing allows fast production of high-quality images with a low cost, and therefore is suitable to large-volume printing. However, maintenance and operation of the offset printing apparatus are difficult.

With the increasing use of personal computers and others, it has been demanded that various kinds of full-color images can be flexibly formed or duplicated by simple operations.

In connection with this, electrophotographic copying machines, printers and others have such advantages that a printing cost per sheet does not substantially increase even if the sheets to be processed are small in number. Compared with other printers of an ink-jet type or the like, the electrophotographic device is superior in printing speed, reproducibility and durability.

In the electrophotographic image formation, the developing method is classified into a dry developing method and a wet developing method.

In the dry developing method, a developer is formed of toner and carrier which has magnetic properties or the like and is added to the toner. Usually, the dry toner includes, as major components, pigment and binder resin, and also includes, if necessary, a charge director, a conductivity control agent, a plasticizing agent, a releasing agent and others in a contained or added fashion. Magnetic toner includes magnetic powder of, e.g., magnetite ($Fe_3O_4$). In the dry developing method, the toner is usually charged by the contact with a specific surface of the developing device, the mutual contact between the toner, contact charging as a result of contact with carrier or the like in the case of two-component developer including the carrier, electrostatic induction by an electric field, charge injection, ion absorption caused by ionizing discharge of air, or the like. The toner thus charged is transported onto an electrostatic latent image portion on an electrostatic latent image carrier such as a photosensitive member, e.g., by an electrostatic, mechanical and/or magnetic forces, and is used for development by an electrostatic force.

The dry toner used for dry development cannot be fine because excessively fine toner may flow into an ambient atmosphere and float therein. Therefore, the toner which is usually used has a relatively large average particle diameter of about 10 $\mu$m. The dry toner having such a relatively large particle diameter can achieve high-density image without difficulty.

In the wet developing method, the liquid developer which is now in the mainstream is formed of electrically insulating carrier liquid, in which toner primarily made of a coloring agent and binder resin as well as a charge director, a dispersion stabilizing agent and others are dispersed. It has been considered that the toner is charged owing to absorption of ions by virtue of the charge director, and the charged toner is used for development on the principle of electrophoresis.

Since there is no possibility that the toner used in the wet development escapes into the atmosphere, fine toner can be used, and the available average particle diameter may be of the order of submicrons. Thereby, the produced image can have a high resolution and a good gray scale property.

For forming the full-color images, developers of four colors, i.e., yellow, magenta, cyan and black are used similarly to the offset printing and others, and images each formed with the developer of the corresponding color are overlapped with each other by a subtractive color mixture method. If these developers of four colors are of a dry type, each developer can be produced by adding appropriate coloring pigment or dye as well as various additives, if necessary, to binder resin in a dispersed fashion, and thereby providing toner of a predetermined particle diameter. In the case of the liquid developer, the developer can be produced by dispersing such toner in the carrier liquid.

Among the toners of respective colors, the yellow toner is primarily formed of Color Index Pigment Yellow (which will also be referred to as "PY" hereinafter) 12, PY13, PY17, PY174, PY176 or the like, which has been widely used in conventional printing ink and others, because these pigments are preferable in view of coloring properties and cost.

However, the above Pigment Yellow contains organically bonded chlorine and heavy metal in the molecule. Therefore, it is proposed to use PY180 which is an azo compound containing no organically bonded chlorine and heavy metal and has excellent color forming ability almost same as conventional Pigment Yellow. PY180 is an azo pigment which has been known under the trade names of Novoperum-Gelb P-HG, Toner Yellow HG VP2155 and others. PY180 and dry toner containing the same are disclosed in U.S. Pat. Nos. 4,870,164 and 4,935,502, European Patent Application No.0 705 886 A2, and others.

However, if the compound classified as PY180 and/or derivative thereof is used as a coloring agent in the toner for the dry development or a coloring agent in the toner of the liquid developer, the toner has a lower chargeability than toner using conventional yellow pigment, and therefore cannot achieve a practically required high developing speed. For achieving high-resolution images, it is necessary to reduce the toner particle diameter. In this case, the toner chargeability must be further increased for achieving the intended developing speed. However, the toner including the compound classified as PY180 and/or derivative thereof has the low chargeability, and therefore cannot provide the fine images.

If the compound classified as PY180 and/or derivative thereof is used as a coloring agent in the toner for the dry development or a coloring agent in the toner of the liquid developer, the dispersibility of pigment in the binder resin is lower than that in the case where the conventional yellow pigment is used, and therefore light transparency of final images is low. If the transparency of each color in the full-color image is not sufficient, the underlying color cannot be sufficiently seen through the upper color, resulting in low reproducibility of each color. If the toner containing PY180 and/or derivative thereof is used, spectral reflection characteristics are low because the pigment has a low dispersibility in the binder resin so that the color reproducibility is low when the colors are converted into numerical values by spectrocolorimetry.

SUMMARY OF THE INVENTION

An object of the invention is to provide yellow toner and yellow liquid developer, which can be used for full-color images, and can achieve good developing properties and good quality of images, and particularly to provide the toner and liquid developer for electrophotographic image formation.

More specifically, an object of the invention is to provide yellow toner and yellow liquid developer which can be used for full-color image formation, and particularly the electrophotographic toner and the electrophotographic liquid developer, which are safe to the environment, and allow fast developing owing to sufficient chargeability of the toner.

Another object of the invention is to provide yellow toner and yellow liquid developer which can be used for full-color image formation, and particularly the electrophotographic toner and the electrophotographic liquid developer, which are safe to the environment, and can provide final images having good transparency, good spectral reflection characteristics and good color reproducibility.

It is known that the chargeability of toner is significantly affected by the surface characteristics of toner such as a kind of functional group. Based on this, the inventors have studied and found that an intended developing speed can be achieved by controlling the acid value of binder resin.

Based on the above findings, the invention provides toner comprising:

binder resin having an acid value in a range from 10 mgKOH/g to 100 mgKOH/g; and at least one kind of compound selected from among Color Index Pigment Yellow 180 and derivatives thereof.

Further, the invention provides a liquid developer comprising:

carrier liquid; and toner including binder resin having an acid value in a range from 10 mgKOH/g to 100 mgKOH/g, and at least one kind of compound selected from among Color Index Pigment Yellow 180 and derivatives thereof.

The inventors have also found that the molecular weight of binder resin affects the dispersibility of pigment in the binder resin of toner. If the binder resin has an excessively low molecular weight, its viscosity is excessively low so that a shearing force cannot be effectively applied to a mixture of the resin and the pigment during a kneading operation for completing the mixture. This results in low dispersibility of pigment. By increasing the molecular weight of the binder resin, the dispersibility of toner in the binder resin can be improved.

Based on the above findings, the invention provides toner comprising:

binder resin having a weight average molecular weight (Mw) in a range from 3000 to 10000; and at least one kind of compound selected from among Color Index Pigment Yellow 180 and derivatives thereof.

Further, the invention provides a liquid developer comprising:

carrier liquid; and toner including binder resin having a weight average molecular weight (Mw) in a range from 3000 to 10000, and at least one kind of compound selected from among Color Index Pigment Yellow 180 and derivatives thereof.

In the later toner and the later liquid developer according to the invention, the binder resin having the weight average molecular weight (Mw) from 3000 to 10000 preferably has a glass transition temperature (Tg) from 30° C. to 65° C. In polymer compounds, the weight average molecular weight and the glass transition temperature are substantially correspond to each other, but a slight shift is present in the correspondence depending on the kind and composition of monomer.

In any case, the liquid developer according to the invention can be considered as a developer having carrier liquid, in which the toner according to the invention is dispersed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
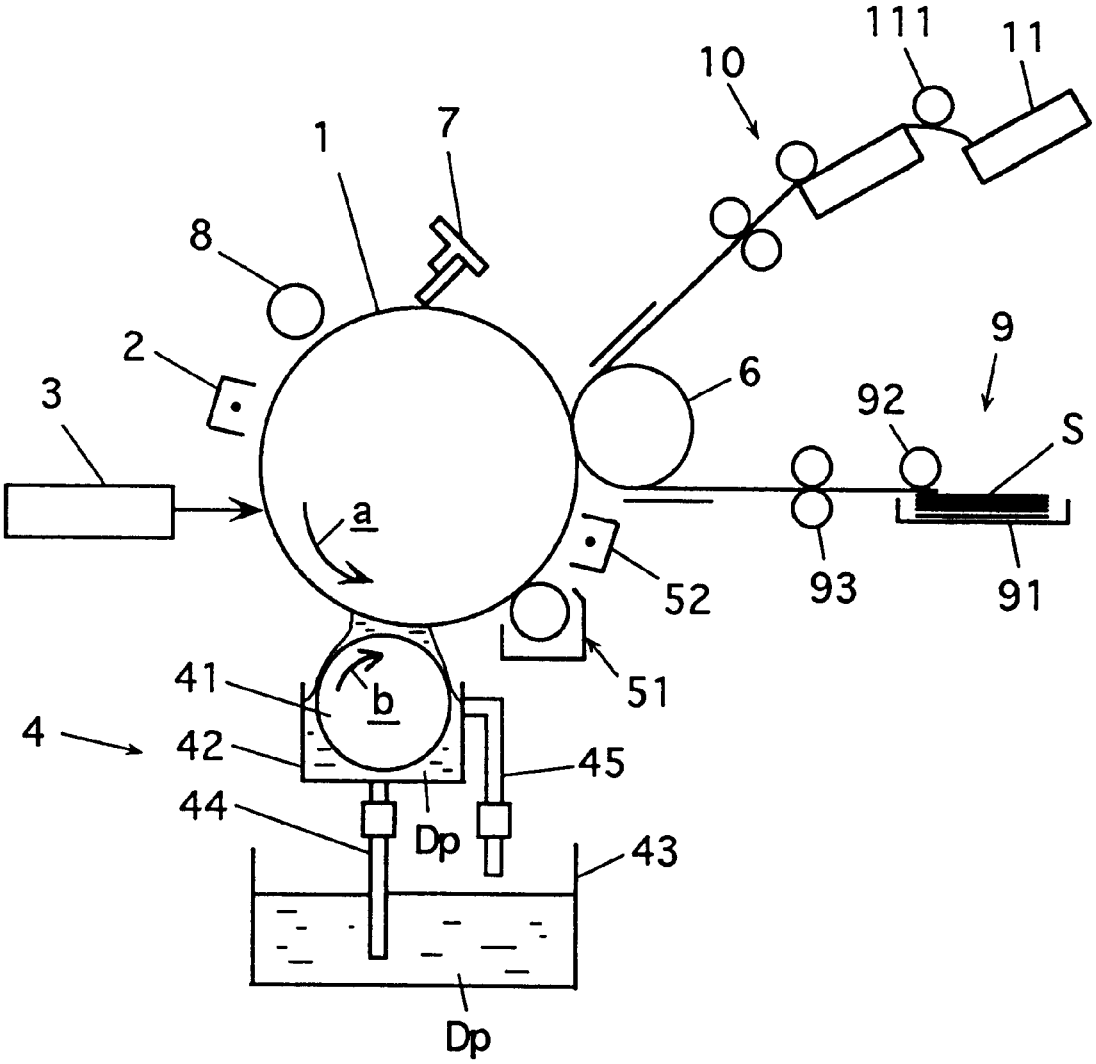
FIG. 1 shows by way of example a schematic structure of an experimental apparatus for image formation.

As embodiments of the toner and the liquid developer according to the invention, the following toner and liquid developer of the first type and the following toner and liquid developer of the second type will be described below.

Toner of the First Type

The toner of the first type is electrophotographic toner primarily including a coloring agent and a binder resin. The toner includes, as the coloring agent, a compound classified as Color Index Pigment Yellow 180 (which will be referred to as "PY180" hereinafter) and/or derivative(s) of the same. The binder resin has an acid value in a range from 10 mgKOH/g to 100 mgKOH/g.

The acid value is a weight in milligram of potassium hydroxide which is required for neutralizing free fatty acid contained in 1 gram of the resin, and can be measured in accordance with JIS K5400 rules.

The electrophotographic toner of the first type can be used as any one of the toner of a dry one-component developer without carrier, the toner of a dry two-component developer used together with solid carrier, and the toner of a liquid developer containing the toner dispersed in carrier liquid.

In the electrophotographic toner of the first type, the coloring agent of the yellow toner is formed of the compound classified as PY180 and/or the derivative(s) thereof, which contain neither organically bonded chlorine nor heavy metal. Therefore, the toner does not adversely affect the environment and others, and is safe. Since the above coloring agent has good coloring properties, beautiful color can be achieved in the full-color image formation.

Since the binder resin has the acid value of 10 mgKOH/g or more, a sufficient amount of free fatty acid is deposited on the toner surface so that a sufficient toner chargeability is achieved, and thus a high developing speed can be achieved. The acid value not exceeding 100 mgKOH/g is employed because an excessively large acid value causes large variations in quantity of charges of the toner in a high-humidity environment, and therefore cannot achieve an intended developing speed. The reason for this is probably that a large amount of moisture is absorbed from the air in the high-humidity environment so that the absorbed moisture changes the characteristics depending on free fatty acid on the toner surface.

Toner of the Second Type

The toner of the second type is electrophotographic toner primarily including a coloring agent and a binder resin. The toner includes, as the coloring agent, a compound classified as Color Index Pigment Yellow 180 (which will be referred to as "PY180" hereinafter) and/or derivative(s) of the same. The binder resin has a weight average molecular weight in a range from 3000 to 10000.

The weight average molecular weight is calculated from values measured by gel permeation chromatography (GPC).

The electrophotographic toner of the second type can be used as any one of the toner of the dry one-component developer without carrier, the toner of the dry two-component developer used together with the solid carrier, and the toner of the liquid developer containing the toner dispersed in the carrier liquid.

In the electrophotographic toner of the second type, the coloring agent of the yellow toner is formed of the compound classified as PY180 and/or the derivative(s) thereof, which contain neither organically bonded chlorine nor heavy metal. Therefore, the toner does not adversely affect the environment and others, and is safe. Since the above coloring agent has good coloring properties, beautiful color can be achieved in the full-color formation.

Since the binder resin has the weight average molecular weight of 3000 or more, and therefore has a relatively high viscosity, a shearing force is effectively applied to a whole mixture in a process of mixing and kneading the binder resin and the pigment PY180 or the like so that PY180 or the like can be sufficiently dispersed in the binder resin. The reason for which the weight average molecular weight does not exceed 10000 is that the melting viscosity increases with molecular weight, and therefore an excessively high molecular weight deteriorates the fixing property of a toner image, which is fixed on a record member by a fixing device at a high temperature, and thus deteriorates the coloring. Since a glass transition temperature increases with molecular weight, an excessively high molecular weight may cause such a situation that the toner is not melted at a predetermined fixing temperature which causes no damage to respective portions of the apparatus.

In the electrophotographic toner of the second type, the binder resin may typically have a glass transition temperature (Tg) in a range from 30° C. to 65° C.

If the glass transition temperature is lower than 30° C., the toner is liable to be deformed even at a room temperature, and the toner may be condensed during preservation or the like. If the glass transition temperature is higher than 65° C., the fixing temperature must be increased so that the respective portions of the apparatus are liable to be damaged, and the cost increases. If the fixing temperature is not sufficiently high, the binder resin is not melted sufficiently, resulting in insufficient coloring of the final images.

The glass transition temperature is a temperature at which a polymer substance changes from a hard glass-like state into a rubber-like state while it is being heated. The glass transition temperature can be used, e.g., by a differential scanning calorimeter.

The electrophotographic toner of first and second types can be manufactured, e.g., by the following manner.

The melted binder resin and the coloring agent are kneaded to disperse the coloring agent in the resin. A charge control agent, a plasticizer or the like may be added to the binder resin.

The coloring agent may be formed of one or more of compounds classified as PY180 and derivatives thereof. More specifically, Novoperum-Gelb P-HG, Toner Yellow HG VP2155 and others may be used. These coloring agents may be added at a rate in a range from 3% to 30% by weight with respect to the binder resin, although the specific rate depends on a particular use, a thickness of the toner layer and others. Preferably, the rate is substantially in a range from 5 wt % to wt %. If the addition rate of coloring agent with respect to the binder resin were smaller than 3 wt %, sufficient coloring might not be achieved. If the addition rate of coloring agent with respect to the binder resin were larger than 30 wt %, the coloring agent might not be dispersed sufficiently in the toner, and/or the toner image transferred onto the record member might not be fixed sufficiently by the heat, in which case it would be unavoidable to reduce the fixing speed.

Various kinds of resin can be used as the binder resin for the toner particles provided that the resin has a thermal plasticity. For example, the binder resin may be thermoplastic saturated polyester resin, styrene/acrylic copolymer resin, styrene/acryl-modified polyester resin, polyolefin copolymer resin (particularly, ethylenic copolymer), epoxy resin, rosin-modified phenol resin or rosin-modified maleic acid resin. These are used singly or in a mixture. With the binder can be blended, as required, a resin such as paraffin wax, polyolefin or the like as a mold releasing agent in an amount up to 20 wt %.

In any one of the above cases, the binder resin having the acid value from 10 mgKOH/g to 100 mgKOH/g is used as the binder resin for producing the toner of the first type. For producing the toner of the second type, the binder resin having the weight average molecular weight (Mw) from 3000 to 10000 is used, and preferably, the resin having the glass transition temperature (Tg) from 30° C. to 65° C. (more preferably, from 30° C. to 60° C.) is used.

For the toner of either the first and second types, the binder resin may be preferably the thermoplastic saturated polyester resin, epoxy resin, styrene acrylic resin or the like. For the toner in the liquid developers, which will be described later, the binder resin may be preferably the thermoplastic saturated polyester resin, ethylenic copolymer, styrene/acrylic resin or the like.

The thermoplastic saturated polyester resin is particularly preferable. The thermoplastic saturated polyester resin can widely change the characteristics of substance such as thermal characteristics, and further can provide beautiful coloring owing to its good transparency for the color image. Moreover, the thermoplastic saturated polyester resin has good ductility and malleability as well as good viscoelasticity so that the fixed resin film can be strong, and can be sufficiently adhered to the record member such as a sheet of paper.

More specifically, the thermoplastic saturated polyester resin is prepared by a polycondensation reaction of polyalcohol and polycarboxylic acid.

Examples of polyalcohol are alkylene glycols (aliphatic glycols) such as ethylene glycol, diethylene glycol, triethylene glycol, 1,2-propylene glycol and like propylene glycols, dipropylene glycol, 1,4-butanediol and like butanediols, neopentyl glycol, 1,6-hexanediol and like hexanediols, alkylene oxide adducts of these alkylene glycols; phenolic glycols such as bisphenol A, hydrogenated bisphenol and like bisphenols, alkylene oxide adducts of these phenolic glycols; aliphatic or aromatic diols such as monocyclic or polycyclic diols; and triols such as glycerin and trimethylolpropane. The polyalcohols are not limited to the above and can be used singly or in a mixture of at least two of them.

Particularly, neopentyl glycol and adduct of bisphenol A and 2–3 moles of alkylene oxide are suitable as the toner binder resin of the liquid developer in view of the stability of the produced polyester resin and the cost. Examples of alkylene oxides are ethylene oxide and propylene oxide.

Examples of polycarboxylic acids are saturated or unsaturated dibasic acids such as malonic acid, succinic acid, adipic acid, azelaic acid, sebasic acid, fumaric acid, maleic acid itaconic acid, phthalic acid and its modified acid (e.g., hexahydrophthalic anhydride), isophthalic acid, terephthalic acid; saturated polybasic acids of at least three functionalities such as trimellitic acid, pyromelltic acid and methyl nadic acid; and acid anhydrides and lower alkyl esters of these polycarboxylic acids. The polycarboxylic acids are not limited to the above and can be used singly or in a mixture of at least two of them.

The isophthalic acid and terephthalic acid are particularly suitable in view of the stability of the produced polyester resin, cost and others.

Conventional known polycondensation reactions are usable as a method of polycondensation. The polycondensation is usually conducted at about 150° C. to 300° C., although depending on the kinds of starting monomer. Polycondensation can be performed under various conditions, for example, using an inert gas as atmosphere gas, various solvents, and/or a normal pressure or a reduced pressure within a reaction vessel. Further, an esterification catalyst can be used for accelerating the reaction. As an esterification catalyst are usable organic metal compounds such as tetrabutylzirconate, zirconium naphthenate, tetrabutyltitanate, tetraoctyltitanate and 3/1 stanous oxalate/sodium acetate. Preferable are those which do not color the ester produced. Alkyl phosphite and aryl phosphite are usable as a catalyst or color adjuster.

The acid value of the produced polyester resin can be controlled by controlling a mixing ratio of polyalcohol and polycarboxylic acid, or a molecular weight of polyester resin.

The molecular weight and the glass transition temperature of the produced polyester resin can be adjusted by controlling a polymerization temperature and a reaction pressure.

The charge control agent (CCA) is an additive which is applied into or onto the toner for applying chargeability to the toner. The charge director may be the same as those which are used as colorless or substantially colorless charge control agent in conventional dry toner. The charge control agent may be salicylic acid salt, borate-containing compound, quaternary ammonium salt or the like. More specifically, the charge control agent may be salicylic acid metal salt such as zinc salicylate or chrome salicylate, derivative(s) of such complex, borate-containing salt compound, quaternary ammonium salt compound or the like.

The plasticizer may be dibutyl phthalate, dioketyl phthalate or the like.

The coloring mixture, which is formed of the binder resin thus produced, the compound classified as the coloring agent PY180 or derivatives threreof, the charge control agent and others, is roughly crushed by a cutter mill, a hammer mill or the like, and then is finely crushed, e.g., by a jet mill or a cryptron to produce the toner having a particle diameter substantially in a range from 6 $\mu$m to 12 $\mu$m.

For improving the flowability and cleanability, the toner particles may be coated with fine powder of silica ($SiO_2$), alumina ($Al_2O_3$), titanium dioxide ($TiO_2$) or the like which is added to the toner particles. Fine powder of metal salt of aliphatic acid such as zinc stearate may be added to the toner particles for preventing damages to a surface of an electrostatic latent image carrier. If the toner is used for the dry two-component developer, the toner is mixed with carrier of glass, iron, nickel, ferrite or the like, which has a spheric form or an indefinite form of tens to hundreds of microns in particle size.

The liquid developers will now be described below.

Liquid Developer of the First Type

The liquid developer of the first type is an electrophotographic liquid developer, in which toner primarily including a coloring agent and a binder resin is dispersed in electrically insulating carrier liquid. The toner includes, as the coloring agent, a compound classified as PY180 and/or derivative(s) of the same. The binder resin of the toner has an acid value of 10 mgKOH/g–100 mgKOH/g.

In the electrophotographic liquid developer of the first type, the coloring agent of the yellow toner is similar to that of the electrophotographic toner of the first type, and thus is formed of the compound classified as PY180 and/or the derivative(s) thereof, which contain neither organically bonded chlorine nor heavy metal. Therefore, the developer is highly safe. Since the above coloring agent has good coloring properties, beautiful color can be achieved in the full-color image formation.

Since the binder resin has the acid value from 10 mgKOH/g to 100 mgKOH/g, sufficiently high toner chargeability is achieved, and a high developing speed can be achieved. Further, variations in charge amount of toner are suppressed even in a high-humidity environment, and therefore an intended developing speed can be achieved.

Liquid Developer of the Second Type

The liquid developer of the second type is an electrophotographic liquid developer, in which toner primarily including a coloring agent and a binder resin is dispersed in electrically insulating carrier liquid. The toner includes, as the coloring agent, a compound classified as PY180 and/or derivative(s) of the same. The binder resin has a weight average molecular weight from 3000 to 10000.

The binder resin in this liquid developer preferably has a glass transition temperature in a range from 30° C. to 65° C., and more preferably in a range from 30° C. to 60° C.

In the electrophotographic liquid developer of the second type, the coloring agent of the yellow toner is similar to that of the electrophotographic toner of the second type, and thus is formed of the compound classified as PY180 and/or the derivative(s) thereof, which contain neither organically bonded chlorine nor heavy metal. Therefore, the developer is highly safe. Since the above coloring agent has good coloring properties, beautiful color can be achieved in the full-color image formation.

Since the binder resin has the weight average molecular weight from 3000 to 10000, a sufficient shearing force can be applied to a mixture in a process of mixing and kneading the binder resin and the pigment PY180 or the like so that PY180 or the like can be sufficiently dispersed in the binder resin, and the good fixing properties can be achieved.

The electrophotographic liquid developers of the first and second types can be manufactured, e.g., by the following manner.

First, the melted binder resin and the compound classified as the coloring agent PY180 and/or the derivative(s) thereof are kneaded to disperse the coloring agent in the resin. In addition to the above, additives such as a charge control agent and a plasticizer may be added to the binder resin. The binder resin, coloring agent, charge control agent and plasticizer may be the same as those already described in connection with the electrophotographic toner. The charge control agent in the liquid developer is added into and/or onto the toner, and cooperates with the charge director, which is added to the carrier liquid and will be described later, to apply a high chargeability to the toner. The charge control agent does not substantially dissolve into the carrier liquid.

The coloring mixture is formed of the binder resin thus produced, the compound classified as the coloring agent PY180 or the like, and others. This mixture is roughly crushed by a cutter mill, jet mill or the like. Wet grinding processing is is effected on the roughly crushed toner in a small amount of carrier liquid in which a charge director is dissolved. Thereby, the toner is further crushed to form a high-concentration liquid developer in which the toner has a particle diameter in a range from about 0.1 $\mu$m to 10 $\mu$m, and more preferably in a range from about 0.5 $\mu$m to 5 $\mu$m. The high-concentration liquid developer thus obtained is diluted with the carrier liquid containing the charge director, if necessary, so that the liquid developer having an appropriate toner concentration is obtained.

The carrier liquid has a resistance value in a range from about $10^{11}$ Ω~cm to $10^{16}$ Ω~cm which does not disturb the electrostatic latent image. The carrier liquid at the room temperature may be in any state provided that the carrier liquid is in the liquid state when it is heated to a temperature higher than the softening point of the dispersed resin in the developing operation. Preferably, it also has a boiling point which allows easy drying after the fixing process. Further, it is preferable that the solvent emits no foul odor, is nonpoisonous and has a relatively low inflammation point.

As a carrier liquid may be used aliphatic hydrocarbon, alicyclic hydrocarbon, aromatic hydrocarbon, halogenated hydrocarbon, polysiloxane and others. Among them, normal paraffin solvent and iso paraffin solvent are particularly preferable in view of odor, harmlessness and cost. Examples of these solvents are 0 grade Solvent L, 0 grade Solvent M, 0 grade Solvent H (all manufactured by Nippon Petrochemicals Co., Ltd.), Isoper C, Isoper E, Isoper G, Isoper H, Isoper L, Isoper M, Isoper K, Isoper V (all manufactured by Exon), Shellsol 71 (manufactured by Shell Oil Co., Ltd.), IP Solvent 1016, IP Solvent 1620, IP Solvent 2028, IP Solvent 2835 (all manufactured by Idemitsu ), Nisseki Isozol 200, Nisseki Isozol 300, Nisseki Isozol 400 (all manufactured by Nippon Petrochemicals Co., Ltd.).

The charge director may typically be an oil-soluble ionic surfactant having at least one alkyl group of at least 20 carbon atoms, and/or a copolymer of a monomer having a nitrogen-containing group and a long-chain (meth)acrylate.

Examples of the oil-soluble ionic surfactant having alkyl group(s) of at least 20 carbon atoms are alkylbenzenesulfonic acid salt having alkyl group(s) of at least 20 carbon atoms (calcium salt, barium salt, etc.), petroleum sulfonic acid salt [barium salt, calcium salt, magnesium salt, etc., and basic petroleum sulfonic acid salt (barium salt, calcium salt, magnesium salt, etc.)]. Particularly preferable are petroleum sulfonic acid salt (barium salt, calcium salt), and basic petroleum sulfonic acid salt (barium salt, calcium salt).

Examples of commercially available such charge directors are Sulfol Ca-45N, Sulfol Ca-45, Sulfol 1040, Molescoamber SC-45N, Molescoamber SC-45, Sulfol Ba-30N, Molescoamber SB-50N (all manufactured by Matsumura Oil Research Corp.), Basic Barium Petronate, Neutral Barium Petronate, Basic Calcium Petronate, Neutral Calcium Petronate, Basic Magnesium Petronate (all manufactured by Witco Chemical Co., Ltd.), and others.

Specific examples of the copolymer of the monomer having the nitrogen-containing group and the long-chain (meth)acrylate are a polymer having as a component a monomer such as (meth)acrylates having an aliphatic amino group, vinyl monomers having nitrogen-containing heterocyclic ring, cyclic amide monomers having N-vinyl substituent, (meth)acrylamides, aromatic substituted ethylenic monomers having nitrogen-containing group, nitrogen-containing vinyl ether monomers, etc. More specifically, the example is a copolymer containing a monomer such as hexyl (meth)acrylate, cyclohexyl (meth)acrylate, 2-ethylhexyl (meth)acrylate, octyl (meth)acrylate, nonyl (meth)acrylate, decyl (meth)acrylate, dodecyl (meth)acrylate, lauryl (meth) acrylate, stearyl (meth)acrylate, vinyl laurate, vinyl stearate, benzyl (meth)acrylate and pheny (meth)acrylate.

Each of the foregoing charge directors may be used solely, or two or more of them may be used in a mixed fashion. The charge director may be added at a rate in a range from about 0.01% to 100% by weight with respect to the toner, although the appropriate value specifically depends on the intended chargeability.

A dispersant (dispersion stabilizer) may be used for stabilizing dispersion of toner particles in the liquid developer. The dispersant (dispersion stabilizer) may be, e.g., a polymer which is absorbed onto the toner particles, has affinity to the carrier liquid, completely or partially dissolves in the carrier liquid or swells with the carrier liquid.

These polymers are not specifically limited, but may include polyolefin type petroleum resin, linseed oil and poly(alkylmethacrylate). In order to enhance affinity to the toner particle, it is possible to use a copolymer containing a monomer having a polar group such as methacrylic acid, acrylic acid and alkylaminoethyl methacrylate. In this case, solubility to the carrier liquid, affinity and adsorption to the toner particle are controlled by an amount of the polar group copolymerized. The larger the amount of the polar group, the lesser the solubility to the carrier liquid and the more the affinity and adsorption to the toner particle.

The dispersant is preferably added to the carrier liquid at the rate from 0.01% to 20% by weight for improving the dispersibility and preventing rise in viscosity of the carrier liquid due to addition of the dispersant. More preferably, the rate is substantially in a range from 0.1% to 10% by weight.

A rate of the total weight of the solid components such as the toner, charge director and dispersant with respect to the total weight of the liquid developer is preferably in a range from about 1% to 90% by weight. For the purpose of reducing the total amount of the liquid developer used for the developing, and thereby facilitating the handling, the total rate of the solid components is more preferably in a range from 2% to 50% by weight.

EXPERIMENTAL EXAMPLES

The invention will now be described below with reference to experimental examples. In the following description, "parts" represents "weight parts", and "Tg" represents a "glass transition temperature" unless otherwise specified. "Mw" represents a weight average molecular weight, and "Mn" represents a number average molecular weight.

In the following experimental examples, the acid value as measured under the conditions specified by JIS K5400.

The weight average molecular weight (Mw) and the number average molecular weight (Mn) were obtained from the result of gel permeation chromatography (GPC), which was performed with a high speed liquid chromatograph pump TRI ROTAR-V type (manufacture by Nippon Bunkou Co., Ltd.), an ultraviolet spectrometer UVIDEC-100-V type (manufacture by Nippon Bunkou Co., Ltd.) and a 50 cm-long column Shodex GPC A-803 (manufacture by Showa Denko Co., Ltd.). The weight average molecular weight (Mw) was obtained as the weight average molecular weight (Mw) in term of polystyrene from the result of the chromatography, and more specifically by adopting polystyrene as the standard substance and calculating the molecular weight of the test sample. The number average molecular weight (Mn) was likewise obtained from the result of the chromatography. The test sample was prepared by dissolving 0.05 g of binder resin in 20 ml of tetrahydrofuran (THF).

The glass transition temperature (Tg) was measured by a differential scanning calorimeter DSC-20 (manufactured by Seiko Denshi Kogyo Co., Ltd.) under the conditions of the sample quantity of 10 mg and the temperature rising speed of 10° C./min. The standard substance was powder of alpha-alumina. The temperature of the test sample was once raised to a value higher than Tg, and then was lowered. Thereafter, the temperature was raised to a value higher than Tg again, and the raised temperature was kept for ten minutes. Thereafter, the value was measured with the second RUN.

The volume average particle diameter was measured with the laser diffraction particle distribution measuring device SALD-1100 (manufactured by Shimazu Seisakusho Co., Ltd.).

First, description is given on the binder resin (thermoplastic saturated polyester resin).

Polyester Resin 1

To a round bottom flask equipped with a reflux condenser, separator of water and alcohol, nitrogen gas introducing tube, thermometer and stirrer were placed 1750 parts of bisphenol A—propylene oxide adduct and 790 parts of isophthalic acid. The mixture was processed to cause polycondensation reaction with dehydration at 200° C. to 240° C. while introducing nitrogen gas thereto and stirring the mixture. When an acid value of the polyester resin thus formed or a viscosity of the reaction solution reached a desired value, the reaction mixture was cooled to or below 100° C. to terminate the polycondensation reaction. The polyester resin 1 thus formed was 8500 in Mw, 3750 in Mn, 58.1° C. in Tg and 9.5 mgKOH/g in acid value.

Polyester Resin 2

Similarly to the manufacturing of the polyester resin 1, the bisphenol A—propylene oxide adduct and the isophthalic acid were processed to cause the polycondensation reaction with dehydration. When an acid value of the polyester resin thus formed or a viscosity of the reaction solution reached a desired value, the polycondensation reaction was stopped. The polyester resin 2 thus formed was 6500 in Mw, 3050 in Mn, 52.3° C. in Tg and 11.0 mgKOH/g in acid value.

Polyester Resin 3

Similarly to the manufacturing of the polyester resin 1, 1700 parts of the bisphenol A—propylene oxide adduct and 890 parts of the isophthalic acid were reacted together. When an acid value of the polyester resin thus formed or a viscosity of the reaction solution reached a desired value, the reaction mixture was cooled to or below 100° C. to terminate the polycondensation reaction. The polyester resin 3 thus formed was 5050 in Mw, 2550 in Mn, 50.9° C. in Tg and 45.2 mgKOH/g in acid value.

Polyester Resin 4

Polyester resin 4 was manufactured similarly to the manufacturing of the polyester resin 1 except for that the reaction was caused between 1250 parts of the bisphenol A—ethylene oxide adduct and 1090 parts of the isophthalic acid instead of the reaction between the bisphenol A—propylene oxide adduct and the isophthalic acid. When an acid value of the polyester resin thus formed or a viscosity of the reaction solution reached a desired value, the reaction mixture was cooled to or below 100° C. to terminate the polycondensation reaction. The polyester resin 4 thus formed was 5900 in Mw, 2350 in Mn, 48.1° C. in Tg and 75.0 mgKOH/g in acid value.

Polyester Resin 5

To a round bottom flask equipped with a reflux condenser, separator of water and alcohol, nitrogen gas introducing tube, thermometer and stirrer were placed 1250 parts of bisphenol A—ethylene oxide adduct and 1090 parts of isophthalic acid. The mixture was processed to cause polycondensation reaction with dehydration at 200 to 240° C. while introducing nitrogen gas thereto and stirring the mixture. An acid value of the polyester resin thus formed or a viscosity of the reaction solution was monitored, and the reaction mixture was cooled to or below 100° C. to interrupt the polycondensation reaction at an appropriate time. Then, 70 parts of trimellitic acid was added, and the reaction temperature was raised to a range between 200° C. and 240° C. for continuing the reaction. When the acid value of the polyester resin thus formed or the viscosity of the reaction solution reached a desired value, the reaction mixture was cooled to or below 100° C. to terminate the polycondensation reaction. The polyester resin 5 thus formed was 5050 in Mw, 2150 in Mn, 45.1° C. in Tg and 95.0 mgKOH/g in acid value.

Polyester Resin 6

To a round bottom flask equipped with a reflux condenser, separator of water and alcohol, nitrogen gas introducing tube, thermometer and stirrer were placed 1250 parts of bisphenol A—ethylene oxide adduct and 1090 parts of isophthalic acid. The mixture was processed to cause polycondensation reaction with dehydration at 200 to 240° C. while introducing nitrogen gas thereto and stirring the mixture. An acid value of the polyester resin thus formed or a viscosity of the reaction solution was monitored, and the reaction mixture was cooled to or below 100° C. to interrupt the polycondensation reaction at an appropriate time. Then, 100 parts of trimellitic acid was added, and the reaction temperature was raised to a range between 200° C. and 240° C. for continuing the reaction. When the acid value of the polyester resin thus formed or the viscosity of the reaction solution reached a desired value, the reaction mixture was cooled to or below 100° C. to terminate the polycondensation reaction. The polyester resin 6 thus formed was 4950 in law, 2130 in Mn, 42.1° C. in Tg and 105.0 mgKOH/g in acid value.

Polyester Resin 7

Similarly to the manufacturing of the polyester resin 1, the bisphenol A—propylene oxide adduct and the isophthalic acid were processed to cause the polycondensation reaction with dehydration. When an acid value of the polyester resin thus formed or a viscosity of the reaction solution reached a desired value, the polycondensation reaction was stopped. The polyester resin 7 thus formed was 10500 in Mw, 4750 in Mn, 68.1° C. in Tg and 5.5 mgKOH/g in acid value.

Polyester Resin 8

Similarly to the manufacturing of the polyester resin 1, the bisphenol A—propylene oxide adduct and the isophthalic acid were processed to cause the polycondensation reaction with dehydration. When an acid value of the polyester resin thus formed or a viscosity of the reaction solution reached a desired value, the polycondensation reaction was stopped. The polyester resin 8 thus formed was 9500 in Mw, 4050 in Mn, 64.9° C. in Tg and 7.5 mgKOH/g in acid value.

Polyester Resin 9

Polyester resin 9 was manufactured similarly to the manufacturing of the polyester resin 1 except for that the reaction was caused between 1700 parts of the bisphenol A—propylene oxide adduct and 890 parts of the isophthalic acid. When an acid value of the polyester resin thus formed or a viscosity of the reaction solution reached a desired value, the reaction mixture was cooled to or below 100° C. to terminate the polycondensation reaction. The polyester resin 9 thus formed was 3050 in Mw, 1550 in Mn, 32.9° C. in Tg and 65.2 mgKOH/g in acid value.

Polyester Resin 10

Polyester resin 10 was manufactured similarly to the manufacturing of the polyester resin 1 except for that the reaction was caused between 1700 parts of the bisphenol A—propylene oxide adduct and 990 parts of the isophthalic acid. When an acid value of the polyester resin thus formed or a viscosity of the reaction solution reached a desired value, the reaction mixture was cooled to or below 100° C. to terminate the polycondensation reaction. The polyester resin 10 thus formed was 2950 in Mw, 1350 in Mn, 28.9° C. in Tg and 75.2 mgKOH/g in acid value.

Experimental examples of manufacturing the liquid developer are as follows.

Description will now be given on experiments relating to the acid value of the binder resin.

Experimental Example 1

A mixture of 60 parts of the foregoing polyester resin 2 and 40 parts of the coloring agent, i.e., PY180 (Toner Yellow HG VP2155 manufactured by Clariant Co., Ltd.) was kneaded at 180° C. for four hours by a kneader with three rolls, and thereby a high-concentration coloring agent mixture was prepared. This high-concentration coloring agent mixture was diluted with the foregoing polyester resin 2 by a kneader, and finally a coloring resin mixture containing 15 wt % of PY180 was prepared. After being sufficiently cooled, this coloring resin mixture was roughly crushed by a cutter mill, and then was finely crushed by a jet mill (Nippon Pneumatic Kogyo Co., Ltd.) to produce coloring toner rough particles having an average particle diameter of about 10 μm. Thirty grams of the coloring toner rough particles were mixed with seventy grams of IP Solvent 1620 solution containing 0.25 wt % of barium salt of petroleum sulfonic acid Sulfol Ba-30N (Matsumura Oil Reseach Corp.). Wet grinding was effected on this mixture by performing processing for 10 hours with a sand grinder (IGARASHI KIKAI SEIZO Co., Ltd.), a media formed of 150 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 2.5 μm was prepared.

The high-concentration liquid developer was diluted by adding 900 parts of IP Solvent 1620 solution containing 0.25 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 8000 rpm for 5 minutes. Thereby, the liquid developer 1 was produced.

Experimental Examples 2, 3 and 4

Liquid developers 2, 3 and 4 each having the volume average toner particle diameter of 2.5 μm were produced in the same manner as the experimental example 1 except for that the polyester resins 3, 4 and 5 were used instead of the polyester resin 2, respectively.

Experimental Examples 5 and 6

Liquid developers 5 and 6 each having the volume average toner particle diameter of 2.5 μm were produced in the same manner as the experimental example 1 except for that the polyester resins 1 and 6 were used instead of the polyester resin 2, respectively.

The toner chargeability of the above liquid developers 1–6 were evaluated in the following manner:

The chargeability was evaluated by measuring the zeta potential (ζ-potential) of the liquid developer in a standard state (15° C. and 25 RH %) and in a high-temperature and high-humidity state (35° C. and 85 RH %). The zeta potential in the system, where particles having surface charges are dispersed in the liquid, represents the potential on the electrostatic double layer at the particle surface, and the zeta potential in the liquid developer is a value related to the chargeability of the toner. As the zeta potential increases, the migration speed of toner in the carrier liquid increases, and intended development can be performed even in a fast system.

The zeta potential was calculated from the particle speed, which was measured with a zeta potential measuring instrument LAZER ZEE MODEL 501 and a non-aqueous measuring system for PEN KEM 501 (both manufactured by PEN KEM Co., Ltd.) in such a manner that toner particles are subjected to a voltage and thereby migrate, and a laser for observation is emitted to the toner particles for measuring the particle speed. Each sample was prepared by diluting the foregoing liquid developer with 100 parts of IP Solvent 1620 solution containing 0.5 wt % of Sulfol Ba-30N.

When the absolute value of the zeta potential was 70 mV or more, and the difference in zeta potential between the standard state and the high-temperature and high-humidity state was 5 mV or less, the good image characteristics could be stably obtained without an influence by the environment. This case was determined as good (O). When the absolute value of the zeta potential was lower than 70 mV, or the difference in zeta potential between the standard state and the high-temperature and high-humidity state was higher than 5 mV, the result was determined as bad (X). The results are shown in the following list.

| | Acid Value | Zeta Potential (mV) | | | Total |
|---|---|---|---|---|---|
| | (mg KOH/g) | Std* | High-Temp/RH* | Df* | Evaluation |
| EX* 1 | 11.0 | 71 | 72 | 1 | O |
| EX* 2 | 45.2 | 95 | 97 | 2 | O |
| EX* 3 | 75.0 | 120 | 122 | 2 | O |
| EX* 4 | 95.0 | 150 | 154 | 4 | O |
| EX* 5 | 9.5 | 68 | 68 | 0 | X |
| EX* 6 | 105.0 | 168 | 175 | 7 | X |

Std*: standard state
High-Temp/RH**: high-temperature and high-humidity state
Df*: difference
EX*: experimental example According to the above, the following can be understood. In the liquid developers 1–4 of the experimental examples 1–4, which include the binder resin having the acid value between 10 mgKOH/g and 100 mgKOH/h, the toner exhibits the high chargeability. The good chargeability, which is similar to that in the standard state, can be obtained even in the high-temperature and high-humidity state. According to the liquid developer 5 of the experimental example 5, in which the binder resin has the acid value lower than 10 mgKOH/g, the zeta potential in the standard state is excessively low. According to the liquid developer 6 of the experimental example 6, in which the binder resin has the acid value exceeding 100 mgKOH/g, the zeta potential in the standard state is sufficiently high, but an excessively large difference is present in zeta potential between the standard state and the high-temperature and high-humidity state.

From the above, it can be understood that the toner, which includes binder resin having an acid value of 10 mgKOH/g–100 mgKOH/g, and at least one kind of compound selected from a group including Color Index Pigment Yellow 180 and derivatives thereof, as well as the liquid developer containing the above toner dispersed in the carrier liquid can achieve the sufficiently high zeta potential as well as the stable chargeability not affected by the environment temperature and humidity, and therefore can stably achieve the fast developing without an influence by the environmental temperature and humidity.

The experimental examples relating to the liquid developers have been described. However, the toner including the coloring agent and binder resin similar to those of the experimental examples may be used as dry toner, in which case the toner can be used for image formation in the basically same manner so that the stable and good toner chargeability can be achieved similarly to the respective experimental examples.

Experiments relating to the weight average molecular weight of the binder resin are as follows:

Experimental Example 7

A mixture of 60 parts of the foregoing polyester resin 8 and 40 parts of the coloring agent, i.e., PY180 (Toner Yellow HG VP2155 manufactured by Clariant Co., Ltd.) was kneaded at 180° C. for four hours by a kneader with three rolls, and thereby a high-concentration coloring agent mixture was prepared. This high-concentration coloring agent mixture was diluted with the foregoing polyester resin 8 by a kneader, and finally a coloring resin mixture containing 15 wt % of PY180 was prepared. After being sufficiently cooled, this coloring resin mixture was roughly crushed by a cutter mill, and then was finely crushed by a jet mill (Nippon Pneumatic Kogyo Co., Ltd.) to produce coloring toner rough particles having an average particle diameter of about 10 μm. Thirty grams of the coloring toner rough particles were mixed with seventy grams of IP Solvent 1620 solution containing 0.25 wt % of barium salt of petroleum sulfonic acid Sulfol Ba-30N (Matsumura Oil Reseach Corp.). Wet grinding was effected on this mixture by performing processing for 10 hours with a sand grinder (IGARASHI KIKAI SEIZO Co., Ltd.), a media formed of 150 cc of glass beads having a diameter of 1 mm, a ⅛-gallon vessel with water-jacket, a cooling water temperature of 20° C. and a disk rotation speed of 2000 rpm. In this manner, the high-concentration liquid developer having a volume average toner particle diameter of 2.5 μm was prepared.

The high-concentration liquid developer was diluted by adding 900 parts of IP Solvent 1620 solution containing 0.25 wt % of Sulfol Ba-30N to 100 parts of the above high-concentration liquid developer. Dispersing processing was effected on this mixture by a dispersing device T. K. autohomomixer M-type (Tokushu Kikai Kogyo Co., Ltd.) with 8000 rpm for 5 minutes. Thereby, the liquid developer 7 was produced.

Experimental Examples 8, 9 and 10

Liquid developers 8, 9 and 10 each having the volume average toner particle diameter of 2.5 μm were produced in the same manner as the experimental example 7 except for that the polyester resins 2, 3 and 9 were used instead of the polyester resin 8, respectively.

Experimental Examples 11 and 12

Liquid developers 11 and 12 each having the volume average toner particle diameter of 2.5 μm were produced in the same manner as the experimental example 7 except for that the polyester resins 7 and 10 were used instead of the polyester resin 8, respectively.

The reproducibility of yellow color of the above liquid developers 7–12 were evaluated in the following manner:

The color reproducibility was evaluated by the actual image forming tests using the respective liquid developers and an image forming apparatus, of which schematic structure is shown in FIG. 1.

The experimental image forming apparatus shown in FIG. 1 is of an electrophotographic type, and is internally provided with a liquid developing device. The apparatus in FIG. 1 has a photosensitive drum 1, and also includes a charger 2, an image exposing device 3 for emitting a laser beam based on an image data sent from a host computer or the like (not shown), a liquid developing device 4, a squeeze roller device 51, a squeeze charger 52, a transfer roller 6, a cleaner 7 and an eraser lamp 8, which are successively arranged around the photosensitive drum 1. Near the transfer roller 6, there are arranged a sheet supply device 9, a fixing device 10 which includes a thermal fixing roller pair for fixing a toner image formed on the sheet, and a discharged sheet tray 11 for receiving sheets discharged from the apparatus. A sheet discharge roller 111 is provided for the discharged sheet tray 11. The sheet supply device 9 includes a sheet cassette 91 accommodating the record sheets S, and a feed roller 92 for feeding the sheets S from the cassette 91. A timing roller pair 93 is arranged between the sheet supply device 9 and the transfer roller 6.

The liquid developing device 4 includes a developing roller 41 which is opposed to the photosensitive drum 1 with a minute space therebetween, and has a lower portion immersed in the liquid developer Dp, a developer retaining tank 42 for retaining the liquid developer Dp around the developing roller 41, a developer reservoir 43 for reserving the liquid developer to be supplied to the developer retaining tank 42, a liquid developer supply device 44 which scoops and supplies the developer Dp in the developer reservoir 43 to the developer retaining tank 42, and a developer collecting device 45 which returns the surplus developer in the developer retaining tank 42 to the developer reservoir 43. The developer Dp in the developer reservoir 43 is appropriately supplied with high-concentration toner liquid from a high-concentration toner supply device (not shown) and thereby keeps a substantially constant toner concentration. A developing gap between the developing roller 41 and the photosensitive drum 1 can be freely adjusted within a range from 0 mm to 2 mm.

For the image formation, the photosensitive drum 1 rotates in a direction of an arrow a in FIG. 1 at a speed of 40 cm/sec, and the charger 2 uniformly charges the surface of the photosensitive drum 1 to carry a surface potential of about −500 V. The image exposing device 3 emits the laser beams based on the image information to the photosensitive drum 1 so that an electrostatic latent image is formed on the surface of the photosensitive drum 1. Thereby, the surface potential of the exposed portion of the photosensitive drum 1 is lowered to about −30 V.

The electrostatic latent image formed on the photosensitive drum 1 is visualized with the liquid developer by the liquid developing device 4. The developing roller 41 rotates at a rotating speed 1.5 times larger than that of the photosensitive drum 1 in a direction of an arrow b in the figure, which is opposite to the rotating direction of the photosensitive drum 1. A developing gap of 100 $\mu$m is kept between the photosensitive drum 1 and the developing roller 41. A bias potential of about −400 V is applied to the developing roller 41 for promoting adhesion of the developer onto the exposed portion and suppressing adhesion of the developer onto the unexposed portion.

Thereafter, the squeeze roller device 51, which rotates in the same direction as the photosensitive drum 1, and the squeeze charger 52 squeeze and remove the surplus liquid developer adhered onto the photosensitive drum 1, and the toner image containing a slight amount of the liquid is formed on the surface of the photosensitive drum 1. The toner image thus formed moves to a transfer position opposed to the transfer roller 6. In the transfer position, the toner image comes into contact with the paper sheet S transferred from the sheet supply device 9, and is electrostatically transferred onto the sheet S. The transfer roller 6 carries a transfer voltage of +1000 V.

The transfer sheet is separated from the photosensitive drum 1, and then is sent to the fixing device 10 which includes a thermal fixing roller pair heated to 150° C. The fixing device 10 fixes the toner image onto the sheet S by the heat and pressure so that image formation on the sheet is completed. The sheet S is then discharged by the discharge roller 111 onto the discharged sheet tray 11. Thereafter, the cleaner 7 removes the residual liquid developer on the surface of the photosensitive drum 1, and the eraser lamp 8 removes the residual charges on the photosensitive drum 1 for the next image formation.

The color reproducibility achieved by the apparatus shown in FIG. 1 was evaluated as follows:

An electrostatic latent image, which has a solid form, and is 3 cm in the longitudinal direction (parallel to the rotation axis of the photosensitive drum 1) and 3 cm in the peripheral direction, was formed on the photosensitive drum 1, and was visualized to provide a solid image of 3 cm by 3 cm. The color of the solid image was measured by a spectrocolorimeter CM-3700d (manufactured by Minolta Co., Ltd.). The L* a* b* colorimetric system was used. The evaluation was made based on the following. When L* was 93 or more, and $\{(a^*)^2+(b^*)^2\}^{1/2}$ was 90 or more, the color reproducibility of yellow was determined as good (O). When L* was lower than 93, or $\{(a^*)^2+(b^*)^2\}^{1/2}$ was lower than 90, the color reproducibility of yellow was determined as bad (X). The results are as follows:

| | Mw | Tg | L* | a* | b* | $\{(a^*)2 + (b^*)2\}^{1/2}$ | EV* |
|---|---|---|---|---|---|---|---|
| EX* 7 | 9500 | 64.9 | 95.9 | −10 | 98 | 98.51 | O |
| EX* 8 | 6500 | 52.3 | 95.8 | −11.1 | 97.9 | 98.53 | O |
| EX* 9 | 5050 | 50.9 | 95.8 | −10.3 | 97 | 97.55 | O |
| EX* 10 | 3050 | 32.9 | 95.7 | −10.2 | 96.5 | 97.04 | O |
| EX* 11 | 10500 | 68.1 | 88.1 | −9.7 | 86 | 86.55 | X |
| EX* 12 | 2950 | 28.9 | 93.1 | −9.7 | 88 | 88.53 | X |

According to the above result, good color reproducibility can be achieved by the liquid developers 7 to 10 of the experimental examples 7 to 10, in which the binder resin has the weight average molecular weight in a range from 3000 to 10000, and the glass transition temperature is in a range from 30° C. to 65° C. According to the liquid developer 11 of the experimental example 11, in which the weight average molecular weight is higher than 10000, and the glass transition temperature is higher than 65° C., the color reproducibility is bad. This is probably due to the fact that the binder resin is not sufficiently melted at the temperature during fixing, and therefore good fixing property cannot be obtained. According to the liquid developer 12 of the experimental example 12, in which the weight average molecular weight is lower than 3000 and the glass transition temperature is lower than 30° C., the color reproducibility is likewise bad. This is probably due to the fact that the binder resin has a low viscosity, and therefore the pigment PY180 is not sufficiently dispersed in the binder resin during kneading.

From the above, it can be understood that the toner, which includes binder resin having the weight average molecular weight in a range from 3000 to 10000 (and more preferably having the glass transition temperature in a range from 30° C. to 65° C.), and also includes at least one kind of compound selected from a group including PY180 and derivatives of the same, as well as the liquid developer containing the above toner dispersed in the carrier liquid can achieve the good dispersibility of the pigment PY180 or the like in the binder resin, and can also achieve good fixing properties so that good yellow color reproducibility can be achieved.

The experimental examples relating to the liquid developers have been described. However, the toner including the coloring agent and binder resin similar to those of the experimental examples may be used as dry toner, in which case the toner can be used for image formation in the basically same manner so that the good yellow color reproducibility can be achieved similarly to the respective experimental examples.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Toner comprising:

binder resin having an acid value in a range from 10 mgKOH/g to 100 mgKOH/g; and at least one kind of compound selected from among Color Index Pigment Yellow 180 and derivatives thereof.

2. A liquid developer comprising:

carrier liquid; and toner including binder resin having an acid value in a range from 10 mgKOH/g to 100 mgKOH/g, and at least one kind of compound selected from among Color Index Pigment Yellow 180 and derivatives thereof.

3. The liquid developer according to claim 2, wherein said binder resin is at least one kind of resin selected from among thermoplastic saturated polyester resin, epoxy resin, ethylenic copolymer and styrene acrylic resin.

4. The liquid developer according to claim 2, further comprising:

at least one kind of compound selected from among salicylic acid salt, borate-containing compound and quaternary ammonium salt.

5. The liquid developer according to claim 2, wherein said carrier liquid is normal paraffin solvent or iso paraffin solvent.

6. The liquid developer according to claim 2, further comprising:

an oil-soluble ionic surfactant having at least one alkyl group of at least 20 carbon atoms.

7. The liquid developer according to claim 2, further comprising:

a copolymer of a monomer having a nitrogen-containing group and a long-chain (meth)acrylate.

8. Toner comprising:

binder resin having a weight average molecular weight in a range from 3000 to 10000; and at least one kind of compound selected from among Color Index Pigment Yellow 180 and derivatives thereof.

9. The toner according to claim 8, wherein said binder resin has a glass transition temperature in a rang from 30° C. to 65° C.

10. A liquid developer comprising:

carrier liquid; and toner including binder resin having a weight average molecular weight in a range from 3000 to 10000, and at least one kind of compound selected from among Color Index Pigment Yellow 180 and derivatives thereof.

11. The liquid developer according to claim 10, wherein said binder resin has a glass transition temperature in a rang from 30° C. to 65° C.

12. The liquid developer according to claim 10, wherein said binder resin is at least one kind of resin selected from among thermoplastic saturated polyester resin, epoxy resin, ethylenic copolymer and styrene acrylic resin.

13. The liquid developer according to claim 10, further comprising:

at least one kind of compound selected from among salicylic acid salt, borate-containing compound and quaternary ammonium salt.

14. The liquid developer according to claim 10, wherein said carrier liquid is normal paraffin solvent or iso paraffin solvent.

15. The liquid developer according to claim 10, further comprising:

an oil-soluble ionic surfactant having at least one alkyl group of at least 20 carbon atoms.

16. The liquid developer according to claim 10, further comprising:

a copolymer of a monomer having a nitrogen-containing group and a long-chain (meth)acrylate.

* * * * *